US005826745A

United States Patent [19]

Kuroyanagi

[11] Patent Number: 5,826,745

[45] Date of Patent: Oct. 27, 1998

[54] STOCKER FOR FLAT HEALDS

[75] Inventor: Kazunori Kuroyanagi, Inasa-gun, Japan

[73] Assignee: Hamamatsu Photonics K.K., Hamamatsu, Japan

[21] Appl. No.: 770,112

[22] Filed: Dec. 20, 1996

[30] Foreign Application Priority Data

Dec. 20, 1995 [JP] Japan ..... 7-331875

[51] Int. Cl.[6] ..... B65H 3/00

[52] U.S. Cl. ..... 221/40; 221/61; 221/46; 221/211; 221/281; 221/312 R; 271/100

[58] Field of Search ..... 271/197, 210, 271/211, 212, 236, 280.1, 280, 312 R, 312 A, 312 B, 312 C, 39, 40, 41, 46, 61, 106, 100; 28/205, 206

[56] References Cited

U.S. PATENT DOCUMENTS

| | | | |
|---|---|---|---|
| 1,191,112 | 7/1916 | Peterson | 28/205 |
| 3,103,057 | 9/1963 | Wieneke | 28/205 |
| 4,047,270 | 9/1977 | John | 28/205 |
| 4,674,935 | 6/1987 | Feliks | 221/211 |
| 4,916,785 | 4/1990 | Tachibana et al. | 28/205 |
| 4,989,301 | 2/1991 | Ishii et al. | 28/206 |
| 5,082,268 | 1/1992 | Santoro | 221/210 |
| 5,282,299 | 2/1994 | Tachibana et al. | 28/208 |
| 5,309,615 | 5/1994 | Tachibana et al. | 28/205 |

FOREIGN PATENT DOCUMENTS

| | | | |
|---|---|---|---|
| 0 298 616 | 1/1989 | European Pat. Off. . | |
| 0 448 957 | 10/1991 | European Pat. Off. . | |
| 0 539 062 | 4/1993 | European Pat. Off. . | |
| 1551 964 | 11/1968 | France | 221/211 |
| 544585 | 9/1992 | France . | |
| 47-31387 | 8/1972 | Japan . | |
| 64-20359 | 1/1989 | Japan . | |
| 1-280051 | 11/1989 | Japan . | |

*Primary Examiner*—H. Grant Skaggs
*Attorney, Agent, or Firm*—Pillsbury Madison & Sutro LLP

[57] ABSTRACT

There is disclosed a stocker for flat healds according to the present invention is a flat heald stocker for stocking a lot of flat healds in order to selectively discharge an arbitrary flat heald A out of the many flat healds A juxtaposed, in which the flat healds A kept in a horizontal state are stacked vertically in a housing, a heald refilling aperture is provided at a top portion of the housing, and a heald drawing opening for discharging the lowermost of the stacked flat healds horizontally is provided at a lower portion of the housing, whereby easy horizontal drawing of flat heald can be achieved.

5 Claims, 11 Drawing Sheets

STOCKER FOR FLAT HEALDS

BACKGROUND OF THE INVENTION

1. Field of the Invention

The present invention relates to a stocker for flat healds utilized in a warp passing apparatus for passing a warp through a mail of flat heald.

2. Related Background Art

An example of conventionally existing stockers for flat healds (which are also called magazines) is the one as described in the bulletin of Japanese Laid-open Patent Application No. 64-20359. The stocker disclosed in this bulletin is provided with an upright, plate-like, fixed member extending vertically, and a pair of upper and lower magazine bars extending horizontally as being fixed at one end to this fixed member. Then, guide holes of ring portions provided at the both ends of flat healds are put through the magazine bars, whereby the upright flat healds are stacked along the horizontal direction. In this way, many flat healds are stocked in the stocker. As shown in FIG. 8, a flat heald A is integrally made of SUS 420 or the like having a spring property and has a flat, slender rod portion 1 of a rectangular cross section, a mail 2 is formed near the center of this rod portion 1, ring portions 3 are provided at the both ends of this rod portion 1, and a guide hole 4 of an elongate hole shape is formed in each ring portion 3. Further, this flat heald A bends easily in the direction of an arrow, has characteristics of being strong against torsion and being resistant to deformation, and is excellent in durability.

The conventional stocker for flat healds, however, employs the magazine bars extending horizontally with one end being fixed to the plate-like fixed member and with the other end being a free end. Therefore, for refilling flat healds A into the stocker, the refilling operation of flat healds A is not easy as it is hindered by a chuck mechanism for driving of healds disposed in front of the free ends of the magazine bars. Namely, at the magazine bars extending horizontally, the end for refilling of flat healds A results in coinciding with the end for drawing-out of flat healds A, which makes the refilling operation of flat healds A difficult. For employing such an arrangement as to perform the refilling of flat healds A with all stockers, a new arrangement for mounting and dismounting the stockers becomes necessary, which would be disadvantageous in terms of cost and structure.

SUMMARY OF THE INVENTION

The present invention has been accomplished in order to solve the above problems, and a specific object of the present invention is to provide a stocker for flat healds which insures stable stocking of flat healds and which also facilitates the refilling operation.

A stocker for flat healds according to the present invention is a stocker for flat healds arranged to stock a lot of flat healds in order to selectively discharge an arbitrary flat heald out of a lot of the flat healds juxtaposed, wherein the flat healds kept in a horizontal state are stacked vertically in a housing, a heald refilling aperture is provided at a top portion of the housing, and a heald drawing opening for discharging the lowermost of the flat healds stacked is provided at a lower portion of the housing.

In the stocker for flat healds according to the present invention, the flat healds are stacked vertically in the housing as being maintained in a horizontal state, whereby the heald refilling aperture can be provided at the top portion of the housing and the heald drawing opening can be provided at the lower front end of the housing. In this way, the aperture for refilling the flat healds and the opening for discharging the flat healds from the housing can be provided separately in the housing, which, upon the refilling operation of flat healds, permits the refilling operation to be performed from above the housing as utilizing the self-weight of healds, thereby facilitating the filling operation of flat healds. Further, provision of the heald refilling aperture at the top portion of the housing permits one to perform the refilling operation as looking into this aperture from the top. Also, provision of the heald drawing opening at the lower front end of the housing permits the guide hole of the lowermost flat heald to be hooked on a pin or the like, whereby the flat heald can be drawn horizontally as being maintained horizontal. Then achieved is so-called "first-in, first-out" that the flat healds once loaded in the stocker are necessarily drawn out.

Also, preferably, a heald receiving slit extending horizontally is provided in the housing in order to keep the flat healds stacked vertically, a top end of this heald receiving slit is formed as the heald refilling aperture, and a front end of the heald receiving slit is formed as the heald drawing opening.

Further, preferably, the housing has a ring receiving frame open at a lower end and at an upper end thereof in a front part of the housing.

Further, the housing comprises a frame body having the heald receiving slit, and a base for supporting this frame body and the ring receiving frame, and a heald receiving bottom surface of the heald receiving slit and a top surface of the base are spaced by a bottom plate of the frame body, whereby while only the lowermost flat heald is bent downward, it can be separated from the other flat healds located thereabove.

Further, preferably, the front part of the housing is provided with a heald separating portion having a suction head for vacuum-sucking a rod portion of the lowermost flat heald from the bottom, the suction head moves up when it is to be vacuum-stuck to the rod portion, and it moves down when separating a front end portion of the flat heald after vacuum-stuck thereto.

Further, preferably, the heald separating portion has a base portion for keeping the suction head standing, a suction pipe fixed to the base portion and having a suction hole communicating with a suction hole in the suction head and with a suction hole in the base portion, and a spring disposed between the base portion and the base of the housing and arranged to urge the base portion in a direction to depart from the base, and the base portion is moved up and down by driving means.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the stocker for flat healds according to the present invention will be described in detail with reference to the drawings.

Figure 1:
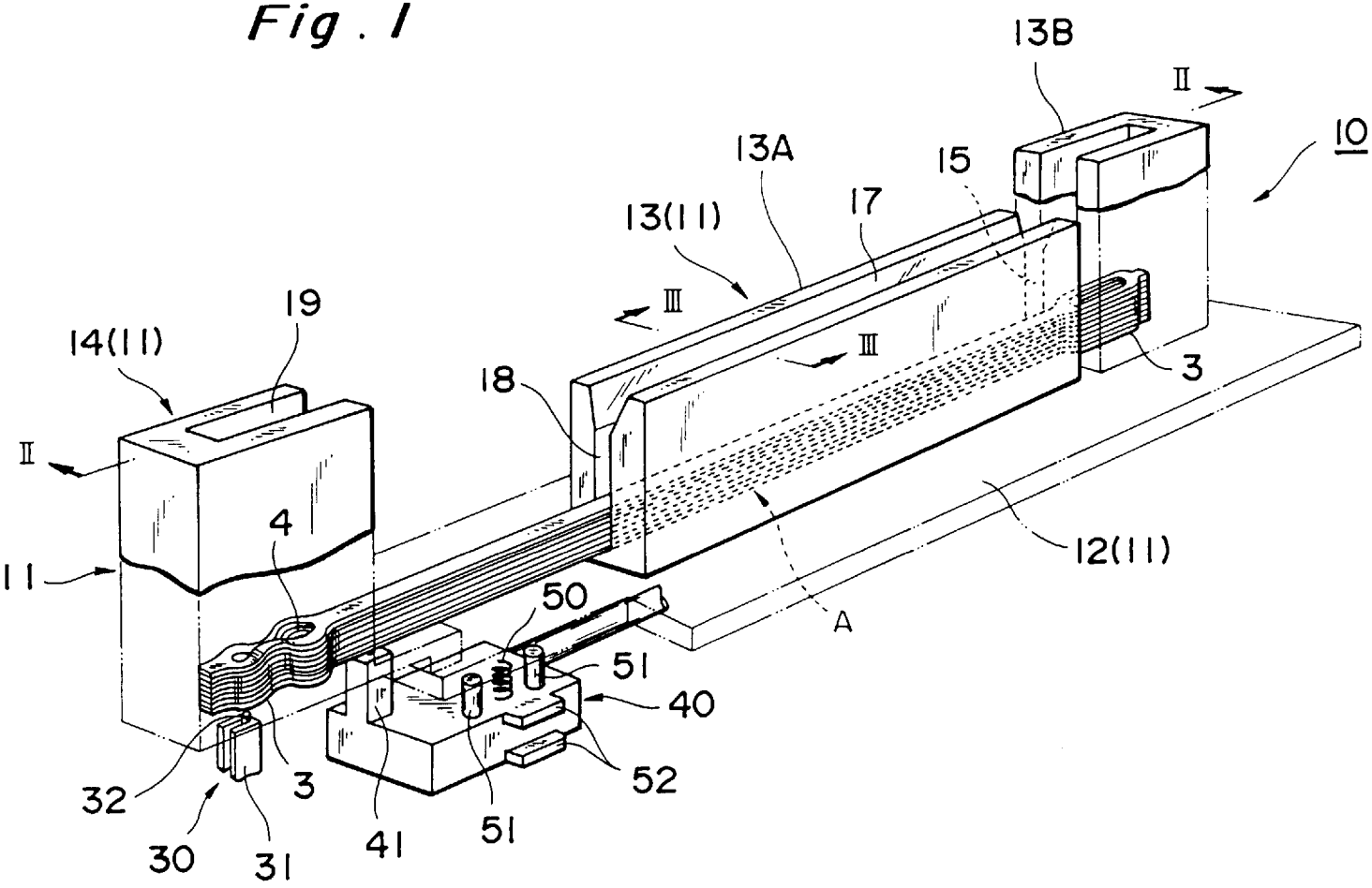
FIG. 1 is a perspective view to show an embodiment of the stocker for flat healds according to the present invention.
Figure 2:
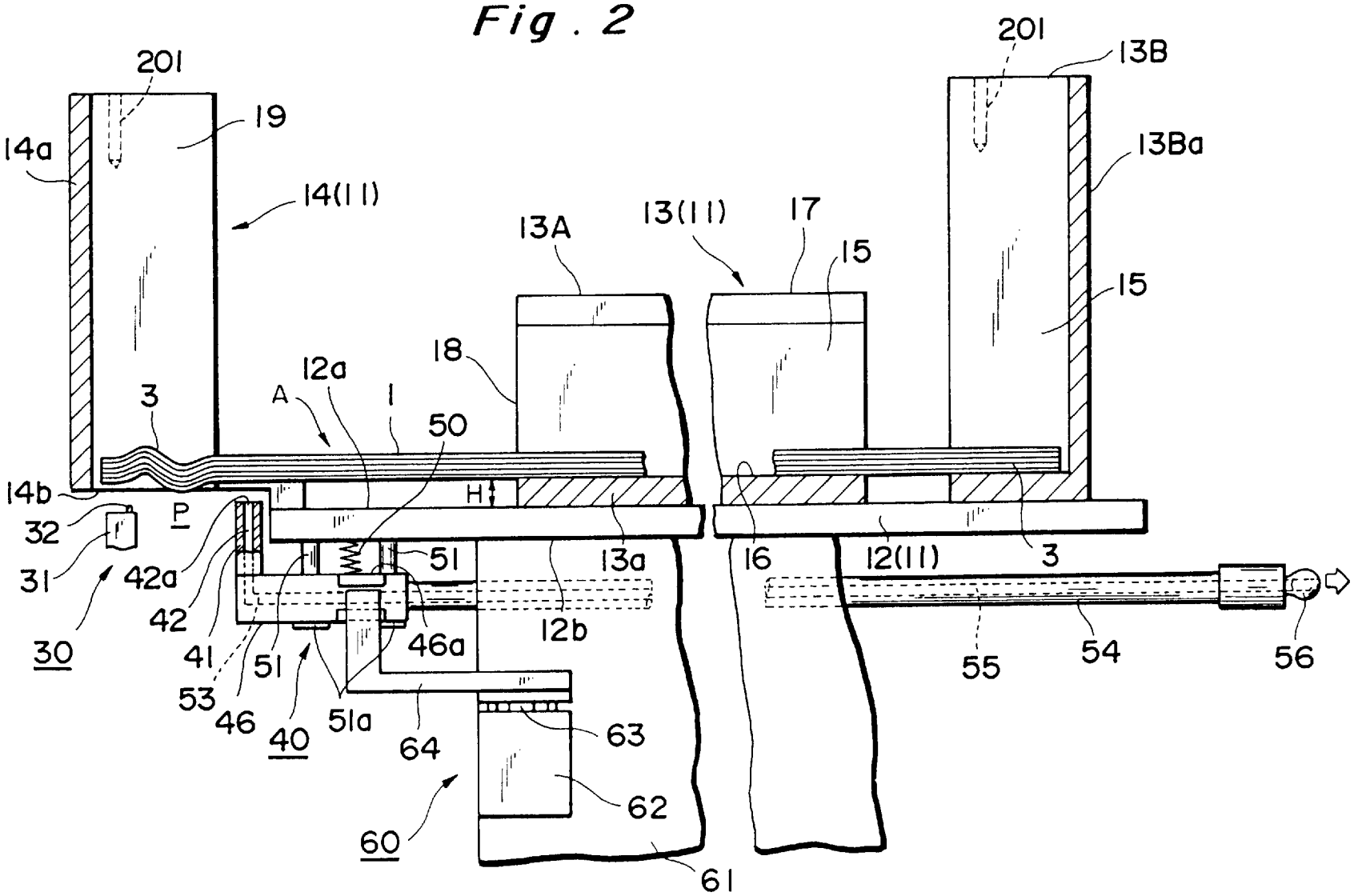
FIG. 2 is a cross-sectional view along line II—II of FIG. 1.

FIG. 1 is a perspective view to show a horizontal placement type stocker for flat healds according to the present embodiment, and FIG. 2 is a cross-sectional view thereof along line II—II of FIG. 1. The flat heald stocker 10 shown in these figures has a housing 11 for keeping the flat healds A horizontal and layered in a vertical stack. This housing 11 is formed to be so slender as to match with the slender shape of flat healds A and comprises a flat base 12, a frame body 13 fixed as standing on this base 12 and receiving the flat healds A in a stacked state, and a ring receiving frame 14 fixed as standing at the front portion on the base 12, for receiving the front ring portions 3.

Figure 3:
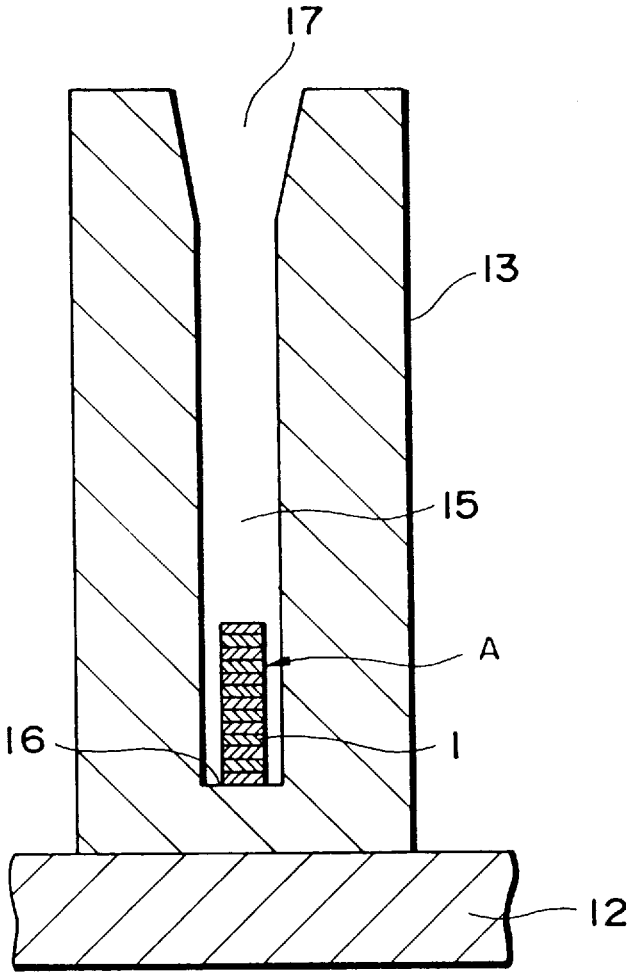
FIG. 3 is a cross-sectional view along line III—III of FIG. 1.

The frame body 13 has a heald receiving slit 15 for keeping the flat healds A stacked vertically, and this heald receiving slit 15 is formed as vertically cutting into the body and has a heald receiving bottom surface 16 extending horizontally (see FIG. 3). Also, the frame body 13 receives a region greater than the half of the length of the flat healds A on the rear side, but does not support the front side of flat healds A. Accordingly, the center of gravity of flat healds A is located in the frame body 13, whereby the frame body 13 can keep the flat healds A stacked vertically as supporting them in an overhang state. The top portion of this frame body 13 is widened in a funnel shape and a heald refilling aperture 17 is provided at the top end thereof, so that the flat healds A can be supplied easily thereinto through the aperture 17 as maintained horizontal.

Further, at the front end of the frame body 13 a heald drawing opening 18 is formed so as to be slender vertically, and this heald drawing opening 18 composes the front end of the heald receiving slit 15. If this heald drawing opening 18 is intended to be used only for drawing the lowermost flat heald A, it will be sufficient to form the opening in a part (lower part) of the front end of the frame body 13.

Further, provided in the foregoing ring receiving frame 14 is a ring receiving slit 19 extending vertically in order to receive the front ring portions 3, and this ring receiving slit 19 is open at the top end, at the lower end, and at the rear end. The top end of the ring receiving frame 14 is open in order to insert the front ring portions 3 from the top, the lower end of the ring receiving frame 14 is open in order to draw the lowermost flat heald A from bottom, and the rear end of the ring receiving frame 14 is opposed to the heald drawing opening 18 and is open in order to receive the flat healds A by cooperation of the ring receiving frame 14 with the frame body 13.

As shown in FIG. 2, predetermined space is provided between the heald receiving bottom surface 16 of the heald receiving slit 15 and a top surface 12*a* of the base 12. This arrangement permits the flat healds A to be properly projected from the heald drawing opening 18 of the frame body 13, and in addition, even if the front parts of the flat healds A are located above the base 12, the front parts of the flat healds A can be kept in a floating state relative to the base 12 as being prevented from touching the base 12. In the present embodiment, such a state is achieved by the thickness H of a bottom plate 13*a* of the frame body 13, and floating amounts of the flat healds A can be adjusted by increasing or decreasing the thickness H of the bottom plate 13*a*. The reason why the front parts of the flat healds A are kept floating relative to the base 12 is that when, in order to separate the lowermost flat heald A from the other flat healds A, the front end portion of the lowermost flat heald A is forcibly drawn by a means such as vacuum suction, the lowermost flat heald A can be surely drawn out with keeping the front end portion of the lowermost flat heald A from touching the front end portions of the flat healds A located thereabove.

As shown in FIG. 1 and FIG. 2, the frame body 13 having the heald receiving slit 15 is comprised of a rod receiving portion 13A for receiving the rod portions 1 of flat healds A and a ring receiving portion 13B for receiving the rear ring portions 3. The rod receiving portion 13A and ring receiving portion 13B may be constructed either separately or integrally. The ring receiving portion 13B of the frame body 13 and the ring receiving frame 14 for receiving the front ring portions 3 are positioned so as to be in the mirror image relation with each other.

In addition, a bottom surface 14*b* of a front wall 14*a* formed in the ring receiving frame 14 is set lower than the height position of the heald receiving bottom surface 16, so that the flat healds A stacked in the housing 11 can be prevented from slipping out from the front wall 14*a*. Additionally, the front wall 14*a* of the ring receiving frame 14 is opposed to a rear wall 13B*a* of the ring receiving portion 13B with the flat healds A in between, so that the flat healds A can be prevented from slipping out longitudinally in the housing 11.

Here, a heald drawing mechanism 30, for example as shown in FIG. 1 and FIG. 2, is provided as a means for drawing the flat healds A stacked in the stocker 10 one by one from the lowermost. This heald drawing mechanism 30 comprises a magnetic head 31 for drawing of heald arranged to move up and down and comprised of an iron core forming a part of an electromagnet, a drawing pin 32 comprised of a non-magnetic member provided at the top part of this magnetic head 31, a piston mechanism (not shown) for moving the magnetic head 31 up and down, and a translational stage (not shown) for moving the magnetic head 31 horizontally.

Figure 6:
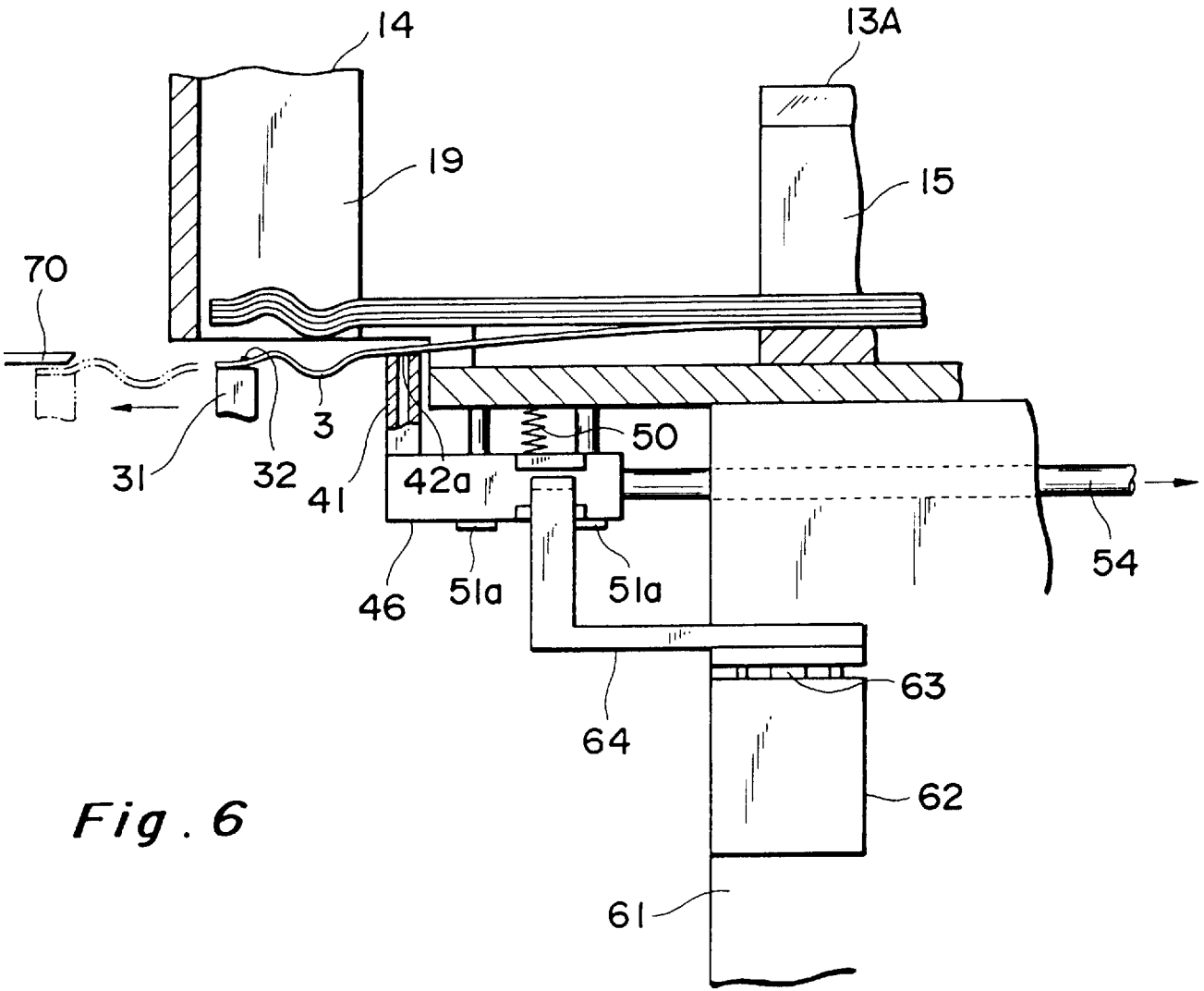
FIG. 6 is a side view to show a state in which the heald separating portion is moved down to separate the lowermost flat heald from the other flat healds.
Figure 7:
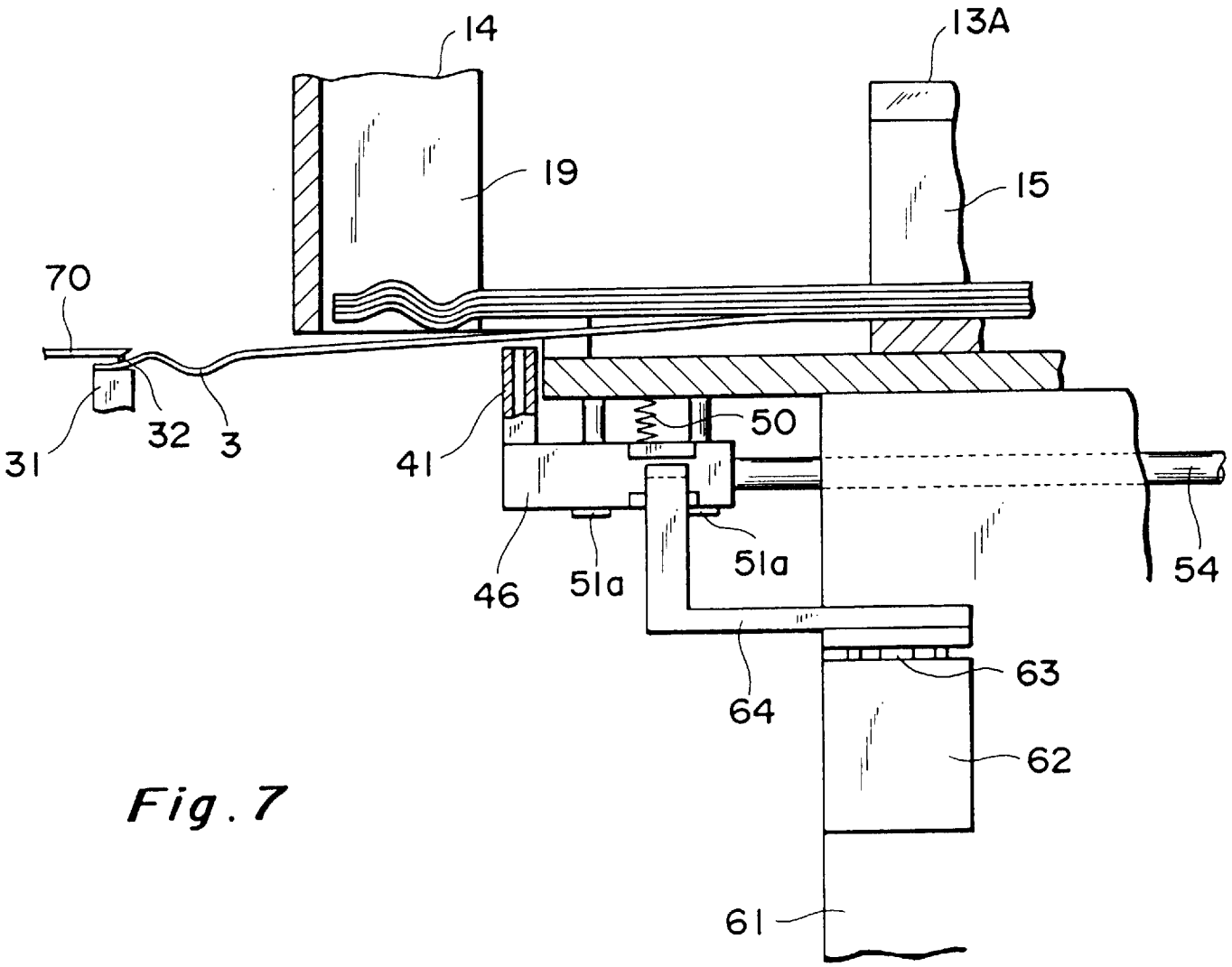
FIG. 7 is a cross-sectional view to show a state in which the lowermost flat heald is drawn out.
Figure 8:
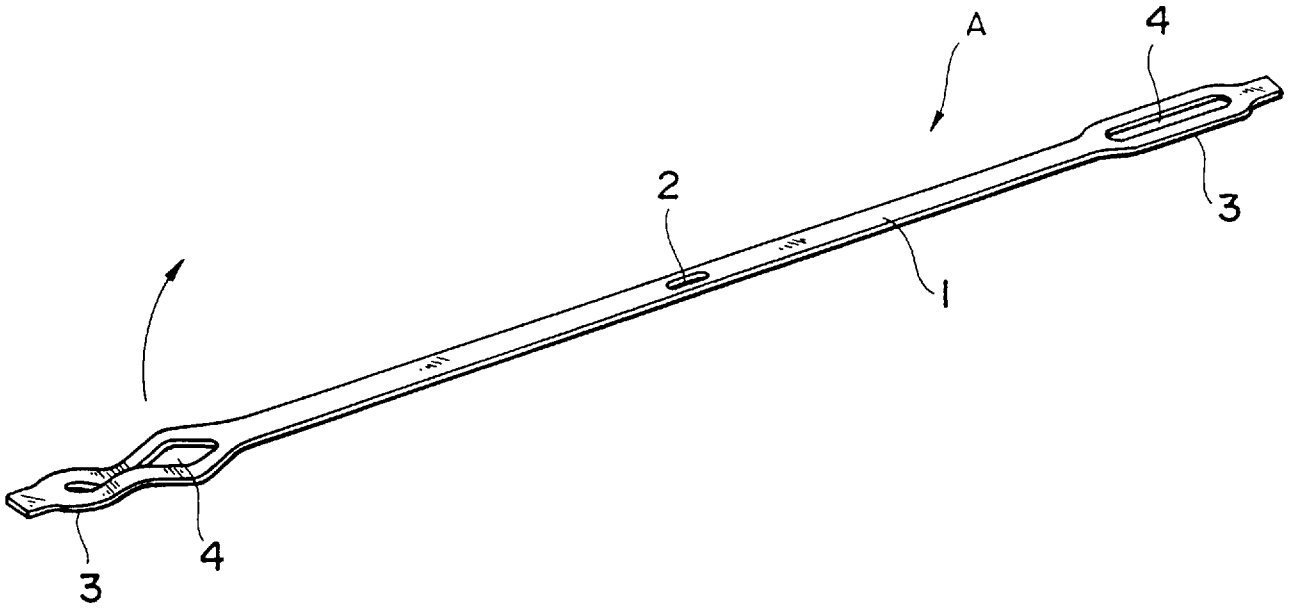
FIG. 8 is a perspective view to show an example of the flat heald.

Therefore, the drawing pin 32 is located immediately below the guide hole 4 in the front ring portion 3, and is inserted into the guide hole 4 of the lowermost flat heald A as pulled downward using a suction head 41 described hereinafter (see FIG. 6). At this time, the magnetic head 31 is energized to make the ring portion 3 magnetically stuck to the magnetic head 31, thereby getting ready for drawing of flat heald A. Then, as shown in FIG. 7, the translational stage (not shown) draws the magnetic head 31 horizontally with hooking the lowermost ring portion 3 on the drawing pin 32, thereby achieving horizontal drawing of flat heald A.

Figure 4:
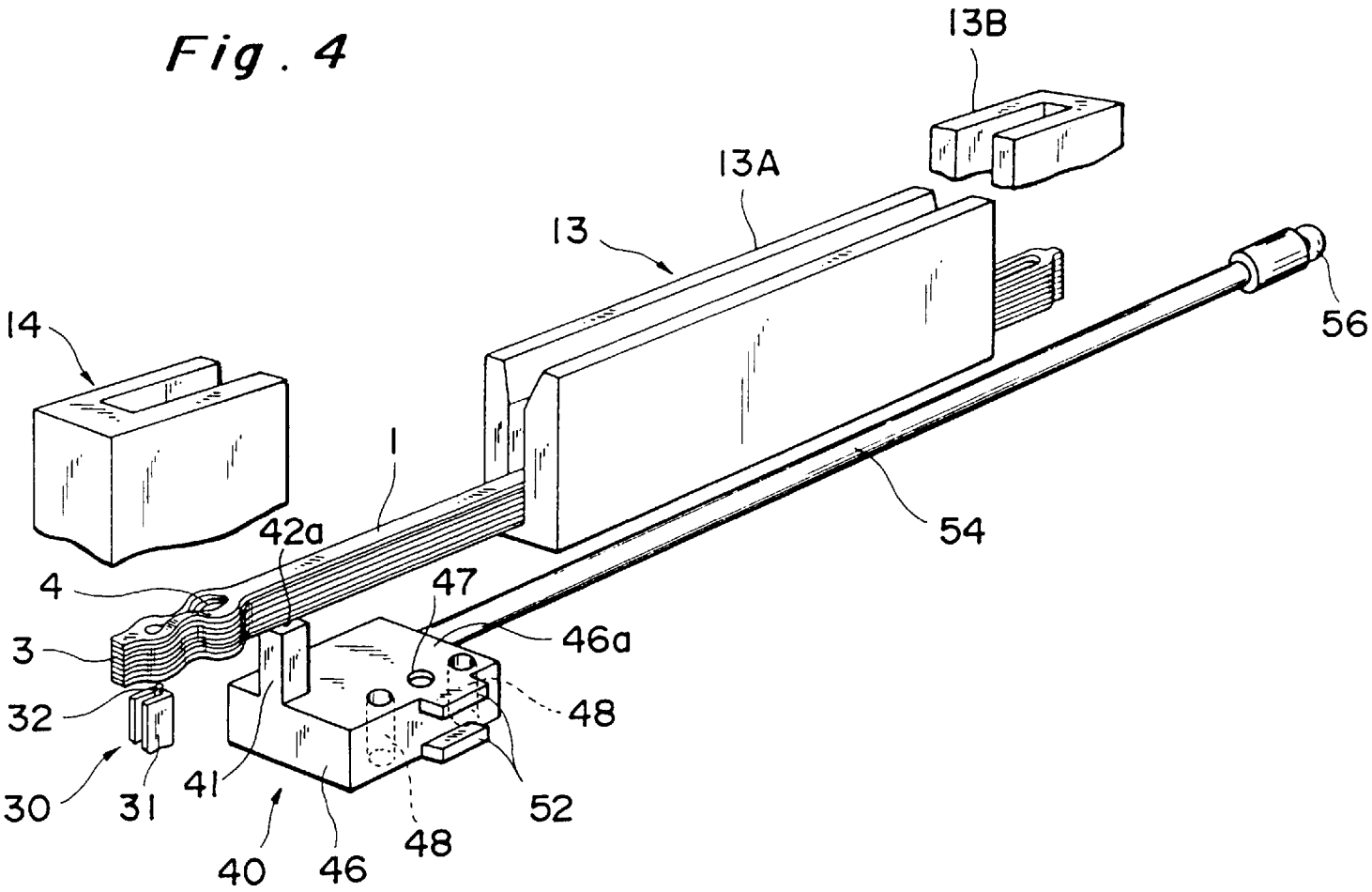
FIG. 4 is a perspective view to show the heald separating portion.

Next, as shown in FIG. 1, FIG. 2 and FIG. 4, the flat heald stocker 10 is provided with a heald separating portion 40 for making drawing of the lowermost flat heald A more certain. This heald separating portion 40 is provided in the front part of the housing 11 and has a suction head 41 for vacuum-sucking the rod portion 1 of the lowermost flat heald A from the bottom. This suction head 41 moves vertically in order to forcibly pull the lowermost ring portion 3 down to the magnetic head 31 and is positioned between the magnetic head 31 and the front end of the base 12 and immediately below the rod portion 1 in the proximity of the front ring portion 3. Further, a suction hole 42 extending vertically is provided in the suction head 41 and a suction port 42*a* exposed as opposed to the rod portion 1 is formed at the top end of this suction hole 42.

Further, the head separating portion 40 has a base portion 46 for fixing the suction head 41 in a standing state, and this base portion 46 is located below the base 12. A recessed portion 47 for a spring to be seated therein is formed in a top surface 46*a* of this base portion 46, and pin inserting holes 48 vertically piercing the base portion 46 are formed on either side of the recessed portion 47 (see FIG. 4). The top surface 46*a* of the base portion 46 and the bottom surface 12*b* of the base 12 are connected through a compression spring 50 seated in the recessed portion 47, and this compression spring 50 urges the base portion 46 in the direction to depart from the base 12. Then, two pins 51 project downward from the bottom surface 12*a* of the base 12, the pins 51 are inserted into the pin inserting holes 48 of the base portion 46, and stopper portions 51*a* comprised of snap rings or the like are provided at the lower end of the pins 51, whereby the base portion 46 can move up and down in the extending direction of the pins 51 under elasticity of the compression spring 50.

As shown in FIG. 2, a suction hole 53 extending horizontally is provided in the base portion 46, and one end of this suction hole 53 is in communication with the suction hole 42 of the suction head 41 while the other end of the suction hole 53 is in communication with a suction hole 55 of a flexible suction pipe 54 fixed to the terminal end of the base portion 46. This suction pipe 54 extends horizontally along the base 12 and moves up and down as following the base portion 46. Also, a connector portion 56 of the suction pipe 54 projects from the rear end of the base 12, and is connected to a vacuum source not shown. Accordingly, by actuating this vacuum source, vacuum suction can be achieved at the suction port 42*a* through the suction holes 42, 53, 55. As shown in FIG. 4, a pair of upper and lower tongues 52 to be engaged with an actuator member 64 described hereinafter are provided in the base portion 46 so as to project therefrom.

Here, a driver 60 moves the base portion 46 up and down, as shown in FIG. 2. This driver 60 comprises an air cylinder 62 fixed to a support stage 61 for supporting the base 12 of the housing 11, a cylinder rod 63 arranged to reciprocate vertically in a predetermined stroke relative to this air cylinder 62 and prevented from rotating, and an actuator member 64 fixed to the tip end of this cylinder rod 63 and engaged with the tongues 52 of the base portion 46 at the tip end thereof. Accordingly, the base portion 46 can be moved up and down by a predetermined amount in accordance with the stroke amount of the cylinder rod 63. Since the actuator member 64 is given a play between the tongues 52 when the tip end of the actuator member 64 is inserted between the tongues 52, the stroke amount of the cylinder rod 63 is not equal to an ascent amount of the base portion 46.

Next, the operation of the heald drawing mechanism 30 will be explained in connection with the heald separating portion 40.

Figure 5:
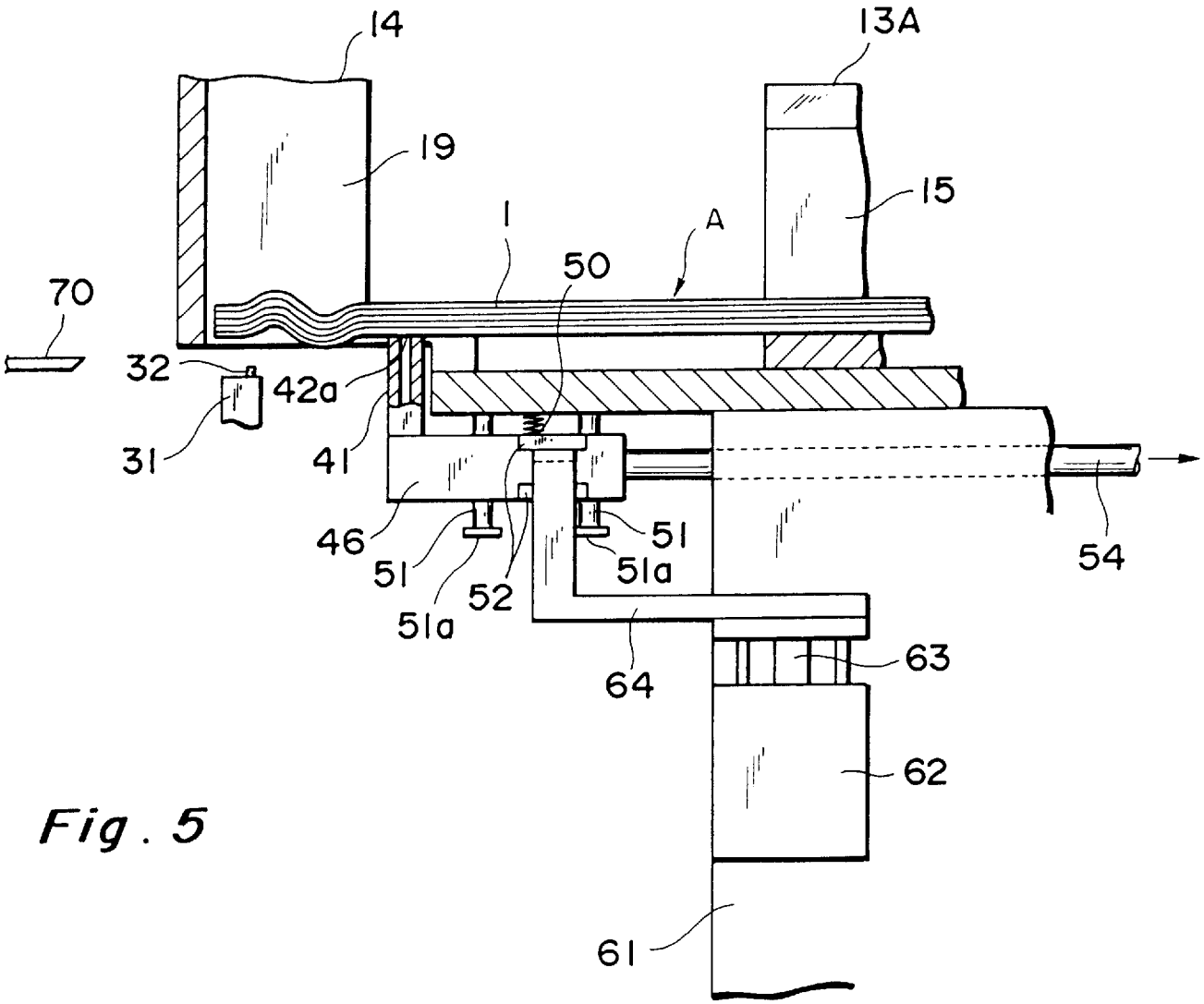
FIG. 5 is a side view to show a state in which the heald separating portion is moved up to bring the top end of the suction head into close proximity of the rod portion.

As shown in FIG. 5, the air cylinder 62 is driven to move the actuator member 64 up, so that the tip end of the actuator member 64 pushes the upper tongue 52 up so as to move the base portion 46 up by the predetermined amount against spring force of the compression spring 50. At this time the top end of the suction head 41 is brought into very close proximity of or into contact with the rod portion 1 of the lowermost flat heald A. After that, the vacuum source not shown is actuated to start vacuum suction by the suction port 42*a*, so as to make the rod portion 1 vacuum-stuck to the top end of the suction head 41. After that, as shown in FIG. 6, the air cylinder 62 is driven to lower the actuator member 64 so that the base portion 46 is moved down to a predetermined position by the spring force of the compression spring 50. At this time, the tip end portion of the lowermost flat heald A is pulled downward as bending the lowermost rod portion 1 vacuum-sucked by the suction head 41. Then the drawing pin 32 is inserted into the guide hole 4 of the lowermost ring portion 3 and thereafter the coil wound around the magnetic head 31 is energized to make the ring portion 3 magnetically stuck on the magnetic head 31.

After that, the magnetic head 31 is moved horizontally so that the drawing pin 32 comes to below a drop preventing plate 70 waiting in front of the magnetic head 31. Then the vacuum suction of flat heald A by the suction head 41 is stopped at this point. If the magnetic sticking force of the magnetic head 31 is strong enough, this vacuum suction may be stopped at the time when the ring portion 3 of the flat heald A comes to magnetically stick onto the magnetic head 31. After that, as shown in FIG. 7, the drop preventing plate 70 and magnetic head 31 are moved horizontally along the translational stage (not shown), whereby stable horizontal drawing of the flat heald A can be achieved as surely hooking the lowermost ring portion 3 on the drawing pin 32 by cooperation of the drop preventing plate 70 with the magnetic head 31.

Figure 9:
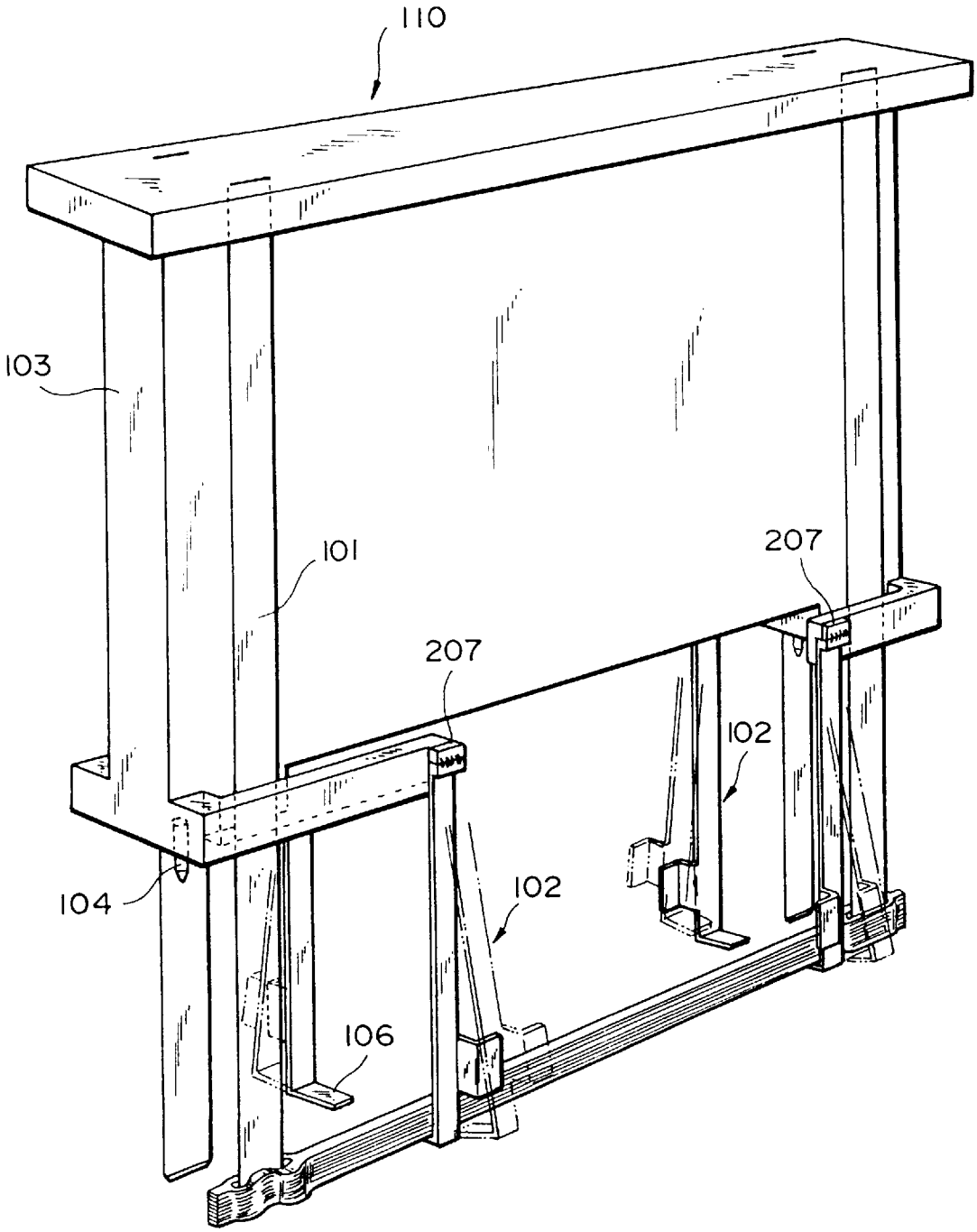
FIG. 9 is a perspective view of a cartridge to be loaded on the stocker according to the embodiment shown in FIG. 1.
Figure 10:
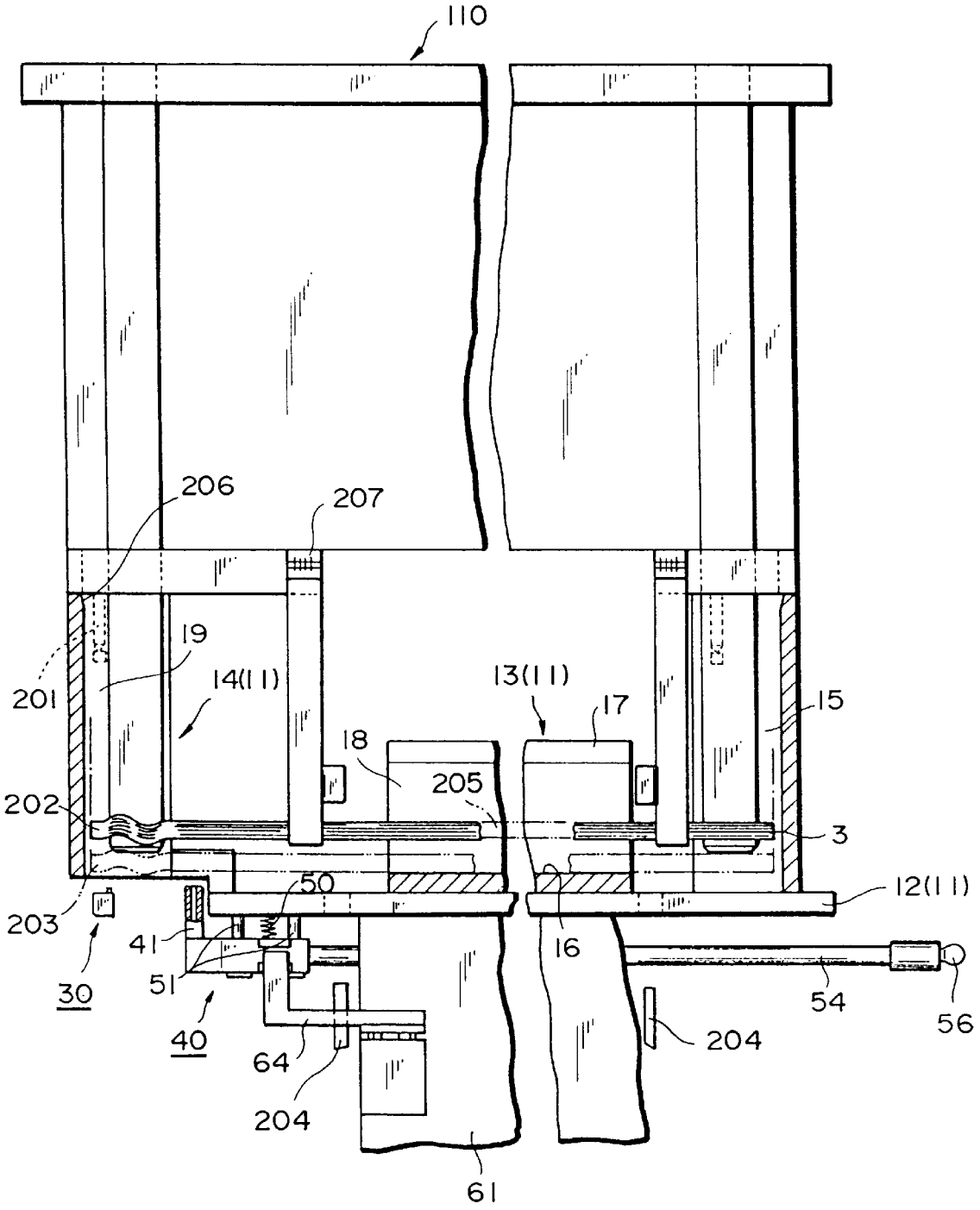
FIG. 10 is a partial sectional view of the stocker on which the cartridge shown in FIG. 9 is mounted.
Figure 11:
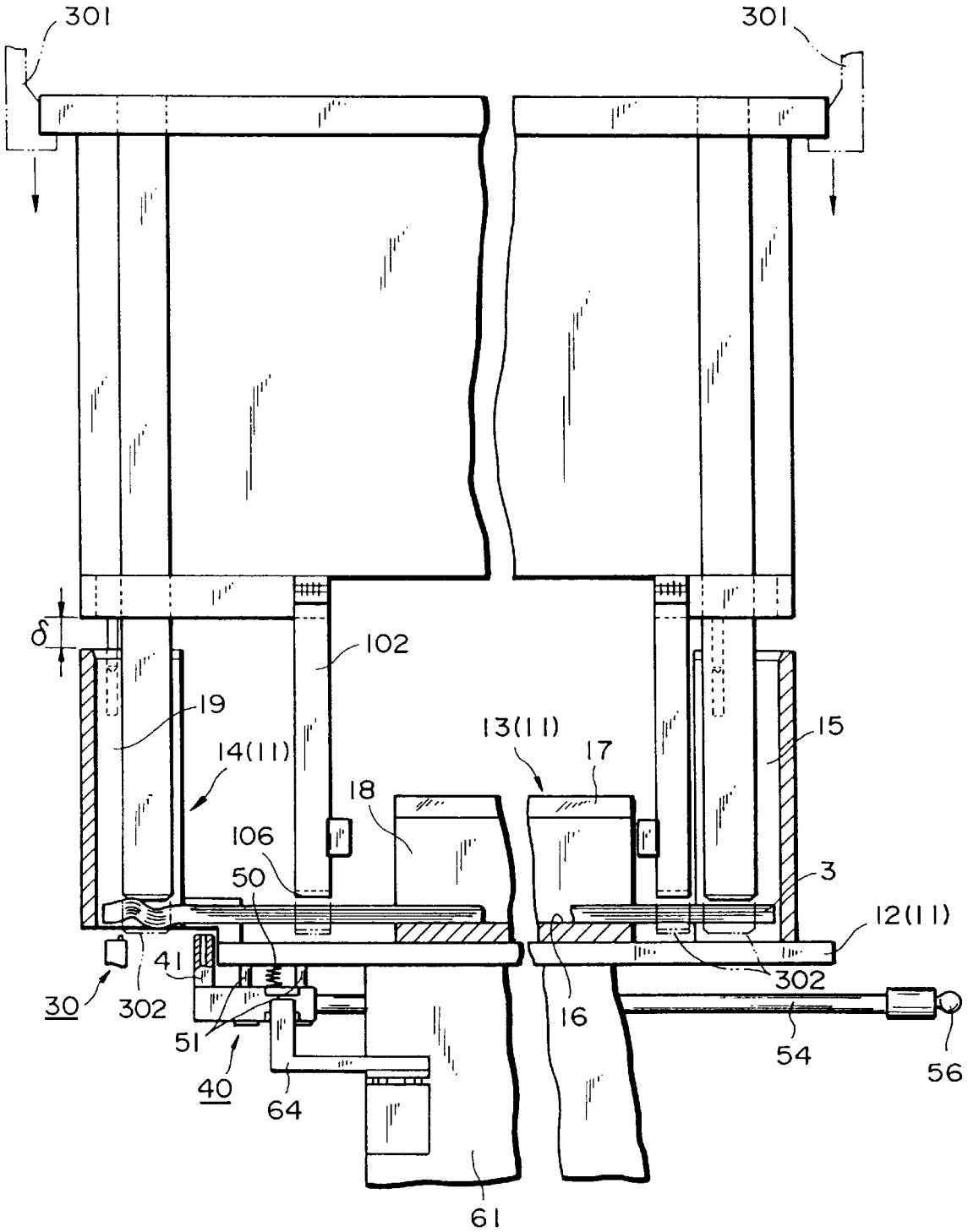
FIG. 11 is a partial perspective view of an another embodiments of the cartridge and the stocker of the present invention.

Next, the easy insertion of the flat healds into the stocker can be realized by using a cartridge 110 for flat healds as shown in FIGS. 9–11. The cartridge 110 for flat healds is mounted on the stocker 10 for enabling the easy insertion of the flat healds into the stocker. The structures and functions of the cartridge will be explained below. The cartridge 110, as shown in FIG. 9, has a bar portion 101 for positioning the flat healds and storing the flat healds thereby, a hook portion 102 for temporally hooking the flat healds to stop the falling of the flat healds and a frame portion 103 for supporting the bar portion 101 and the hook portion 102. The hook portion 102 has a pair of hooks 106 and the hook 106 is swingable mounted on the frame portion 103 by a spring hinge 207. The hooks are swingable as shown in dashed line and solid lines of FIG. 9 by actuators (not shown). Further the flame portion 103 has a pin portion 104 for positioning the cartridge 110 against the stocker 10. The stocker 10 has holes 201 for receiving the pin portion 104 and in engagement of the pin portions 104 and the holes 201, the cartridge 110 is accurately positioned against the stocker 10. Next the falling of the flat healds stored in the cartridge 110 is controlled by the swing movement of the hooks 106. That is, when the hook 106 is on a position in shown in solid lines of FIG. 9, the flat healds is held in the cartridge 110 by support of the hooks 106, and when the hook 106 is on a position as shown in dashed lines of FIG. 9 by release of the hooks 106, the flat healds fall into the stocker 10.

The loading operation of the cartridge 110 on the stocker 10, the insertion operation of the flat healds from the cartridge 110 into the stocker 10 and the removing operation of the cartridge 110 from the stocker 10 will be explained below referring FIGS. 10 and 11. Firstly, the flat healds are mounted in the cartridge 110 by passing the bar portion 101 into the guide hole 4 of the flat healds. Next the cartridge 110 is mounted on the stocker 10 and the pin portion 104 is inserted into the hole 201 of the stocker 10 so that the cartridge 110 is positioned against the stocker 10. FIG. 10 shows the condition under which the cartridge 110 has been mounted on the stocker 10. Next, the actuator (not shown) is driven so that the hooks 106 swing as shown in the dashed lines of FIG. 9 and as the result, the stored flat healds 202 fall in a position shown by reference numeral 203 and the flat healds can be picked from the stocker 10. Further, the stocker has a chamfering portion 206 on an entrance portion of the stocker and therefore the flat healds smoothly fall down into the stocker 10. After completion of warp passing, the flat healds left in the stoker 10 is picked up from the stocker 10 according to the following steps. The flat healds left in a position designated by reference numeral 203 are lifted up to a position designated by the reference 202 by lifting a rod 204 crossing under the flat healds to a position shown in the reference numeral 205. All of the flat healds left in the stocker 10 is moved from the stocker 10 to the cartridge 110, and thereafter, the hooks 106 are driven by the actuator so that the hooks 106 hock the lifted flat healds to maintain them in the cartridge 110. Next, the cartridge 110 is lifted so that the cartridge 110 is separated from the stocker 10. In the above operation, the loading and picking of the flat healds on and from the stocker 10 can be easily performed.

Further, another embodiments of the cartridge is shown in FIG. 11. In the another embodiments, the cartridge 110 is constructed so that after the mounting of the cartridge 110 on the stocker 10, the cartridge can be further moved downwardly by δ and at the lowmost position of the cartridge, the hooks 106 is positioned under the flat healds stored in the stocker 10 as shown in the dashed line 302 of FIG. 11. In order to pick up the flat healds left in the stocker 10 after completion of warp passing, the cartridge 110 is moved downwardly by a cartridge holder 301 so that the clearance δ decreases to zero. The hooks 106 is driven so that the flat healds left in the stocker 10 are hung by the hooks 106, and thereafter the hung flat healds are picked up from the stocker 10 by upwardly moving the cartridge 110. The upward movement of the cartridge 110 is performed by upward movement of the cartridge holder 301. In the above another embodiment of the cartridge, the picking of the left flat healds from the stocker 10 can be performed without using the rod as provided in the previous embodiments so that the structure becomes more simple.

In the above embodiments, a stocker for flat healds is explained but because the flat heald is similar to a dropper in structure, the above embodiments can be applied to a stocker for droppers also.

The present invention is by no means limited to the above-stated embodiment. For example, instead of the separate arrangement of the ring receiving frame 14 and frame body 13 on the base 12 as shown in FIG. 1, the frame body 13 and ring receiving frame 14 may be formed integrally. In this case, the heald drawing opening is preferably provided at the portion indicated by symbol P in the lower front end of the housing 11, as shown in FIG. 2. It is also possible to employ an arrangement in which a plurality of frame bodies 13 are juxtaposed on the base 12. In the case of this arrangement, flat healds A can be drawn one by one in order from the ends of the plural frame bodies 13 juxtaposed or can be drawn one each at the same time from the all frame bodies 13 juxtaposed.

The stocker for flat healds according to the present invention can attain the following effects because it is arranged as described above.

Namely, by the arrangement in which the flat healds kept in a horizontal state are stacked vertically in the housing, in which the heald refilling aperture is provided at the top portion of the housing, and in which the heald drawing opening for discharging the lowermost of the stacked flat healds in the horizontal direction is provided at the lower portion of the housing, stable stocking of flat healds in the housing can be insured. Further, upon the refilling operation of flat healds, the refilling operation can be performed from the top of the housing as utilizing the self-weight of healds or the like, and thus the refilling operation of flat healds becomes easy. Also, the refilling operation can also be carried out as looking into the heald refilling aperture from the top. Further, by the arrangement in which the heald drawing opening is provided in the lower part of the housing, the flat heald can be drawn horizontally as maintained in the horizontal state, with hooking the guide hole of the lowermost flat heald on the pin or the like.

Also, provision of the heald separating portion permits drawing of the lowermost flat heald to be carried out more certainly. Then, noting the flat shape of the rod portion in the flat heald, it becomes possible upon separation of flat heald to realize the heald separator with keeping the rod portion vacuum-stuck to the top portion of the suction head.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 331875/1995 filed on Dec. 20, 1995 is hereby incorporated by reference.

What is claimed is:

1. A stocker for flat healds, which, in order to selectively discharge an arbitrary flat heald out of a lot of flat healds juxtaposed, is arranged to stock a lot of said flat healds, said stocker comprising:

a housing within which said flat healds, oriented horizontally, are stacked vertically, said housing having a heald refilling aperture provided at a top portion thereof and a heald drawing opening provided at a lower portion thereof for discharging a lowermost of the flat healds stacked within said housing, wherein said housing comprises:

a ring receiving frame at a front portion of said housing, said ring receiving frame being open at lower end thereof and at an upper end thereof;

a frame body having a bottom plate and a heald receiving channel, a top surface of said bottom plate defining a bottom surface of said heald receiving channel; and a base for supporting the frame body and said ring receiving frame, wherein the bottom surface of said heald receiving channel and a top surface of said base are spaced by a thickness of said bottom plate of said frame body.

2. A stocker for flat healds according to claim 1, wherein said heald receiving channel extending horizontally is provided in said housing in order to keep said flat healds stacked vertically, and wherein a top end of said heald receiving channel constitutes said heald refilling aperture, and a front end of said heald receiving channel constitutes said heald drawing opening.

3. A stocker for flat healds according to claim 1, wherein the front part of said housing is provided with a heald separating portion having a suction head for vacuum-sucking a rod portion of the lowermost flat heald from the bottom, said suction head moves up when it is to be vacuum-stuck to said rod portion, and said suction head moves down when separating a front end portion of said flat heald after being vacuum-stuck thereto.

4. A stocker for flat healds according to claim 3, wherein said heald separating portion has a base portion for keeping said suction head standing, a suction pipe fixed to said base portion and having a suction hole communicating with a suction hole in said suction head and communicating with a suction hole in said base portion, and a spring disposed between said base portion and the base supporting the frame body and arranged to urge said base portion in a direction to depart from said base, and wherein said base supporting the frame body portion is moved up and down by driving means.

5. A stocker for flat healds according to claim 1, further comprising a cartridge mountable on said stocker, wherein said cartridge comprises a bar portion for positioning and storing the flat healds and a hook portion for hooking the flat healds.

* * * * *